US007201489B2

(12) United States Patent
Shyu

(10) Patent No.: US 7,201,489 B2
(45) Date of Patent: Apr. 10, 2007

(54) CEILING FAN LIGHT LED ASSEMBLY DEVICE

(76) Inventor: Shing-Jy Shyu, No. 5, Lane 373, Sec. 1, Mingjhih Rd., Taishan Township, Taipei County 243 (TW)

( * ) Notice: Subject to any disclaimer, the term of this patent is extended or adjusted under 35 U.S.C. 154(b) by 0 days.

(21) Appl. No.: 11/152,187

(22) Filed: Jun. 15, 2005

(65) Prior Publication Data

US 2006/0285310 A1 Dec. 21, 2006

(51) Int. Cl.
*F21S 8/00* (2006.01)

(52) U.S. Cl. ..... 362/147; 362/251

(58) Field of Classification Search ..... 362/147–148, 362/800, 249, 251, 368
See application file for complete search history.

(56) References Cited

U.S. PATENT DOCUMENTS 5,082,422 A * 1/1992 Wang ..... 416/5
2003/0117804 A1* 6/2003 Shyu ..... 362/280
2004/0042218 A1* 3/2004 Wang et al. ..... 362/368
2005/0024870 A1* 2/2005 Coushaine ..... 362/249
2005/0058584 A1* 3/2005 Shyu ..... 422/305

* cited by examiner

*Primary Examiner*—Renee Luebke
*Assistant Examiner*—Julie A. Shallenberger
(74) *Attorney, Agent, or Firm*—Troxell Law Office, PLLC

(57) ABSTRACT

A ceiling fan light LED assembly device, wherein a plurality of light-emitting bodies are disposed within light tubes, and a drive circuit within a mount disc directly actuates the light-emitting bodies to emit light. Furthermore, a reflecting protective cover having a light focusing and refracting effect is disposed on the mount disc, which is not only able to transmit light emitted by the light-emitting bodies H through the reflecting protective cover F6, but is also able to transmit the light through an arched surface of the transparent shade I, thereby enhancing illumination effectiveness of the refracted light rays.

5 Claims, 10 Drawing Sheets

CEILING FAN LIGHT LED ASSEMBLY DEVICE

BACKGROUND OF THE INVENTION (a) Field of the Invention

The present invention relates to a ceiling fan light LED (light emitting diode) assembly device, characterized in that a drive circuit, which enables light-emitting bodies to emit illumination light.

(b) Description of the Prior Art

Referring to FIGS. 1 and 2, which show a conventional ceiling fan light A including a light body A2 mounted on a suspended mount A1. The light body A2 is configured with illuminating light tubes A3, which are affixed to the light body A2 using fasteners A4. A controller A5 and a pull chain switch A6, which are disposed within the light body A2, and a pull chain A7 of the pull chain switch A6 are used to actuate a cutover switch action that simultaneously causes a fan affixed to the suspended mount A1 to rotate and the light tubes A3 to emit illumination.

The light tubes A3 disposed within the light body A2 are manufactured from glass with the addition of lead, fluorescent powder, mercury and related elements having properties to act as a transmitting light source. Moreover, a relatively high voltage is needed when the light tubes disposed within the light body A2 are emitting light, thus, operating lifespan is relatively short. Furthermore, concern over environmental pollution resulting from discarding the light tubes A3 cannot be overlooked.

Hence, the inventor of the present invention proposes to resolve and surmount existent technical difficulties to eliminate the aforementioned shortcomings.

SUMMARY OF THE INVENTION

The present invention is to provide a ceiling fan light LED (light emitting diode) assembly device, characterized in that a drive circuit, which enables light-emitting bodies to emit illumination light, and a pull chain switch, which controls rotating of a fan of a suspended mount and a cutover switch action, are disposed within a holding space of a mount disc. When a pull chain of the pull chain switch effectuates a cutover switch action, the pull chain switch thereupon actuates the drive circuit within the mount disc, thereby enabling the light-emitting bodies to emit illumination light.

Furthermore, a reflecting protective cover having a light focusing and refracting effect is disposed on the mount disc, which is not only able to transmit light emitted by the light-emitting bodies through the reflecting protective cover, but is also able to transmit the light through an arched surface of the transparent shade, thereby enhancing illumination effectiveness of the refracted light rays.

To enable a further understanding of said objectives and the technological methods of the invention herein, brief description of the drawings is provided below followed by detailed description of the preferred embodiments.

DETAILED DESCRIPTION OF THE PREFERRED EMBODIMENTS

Figure 3:
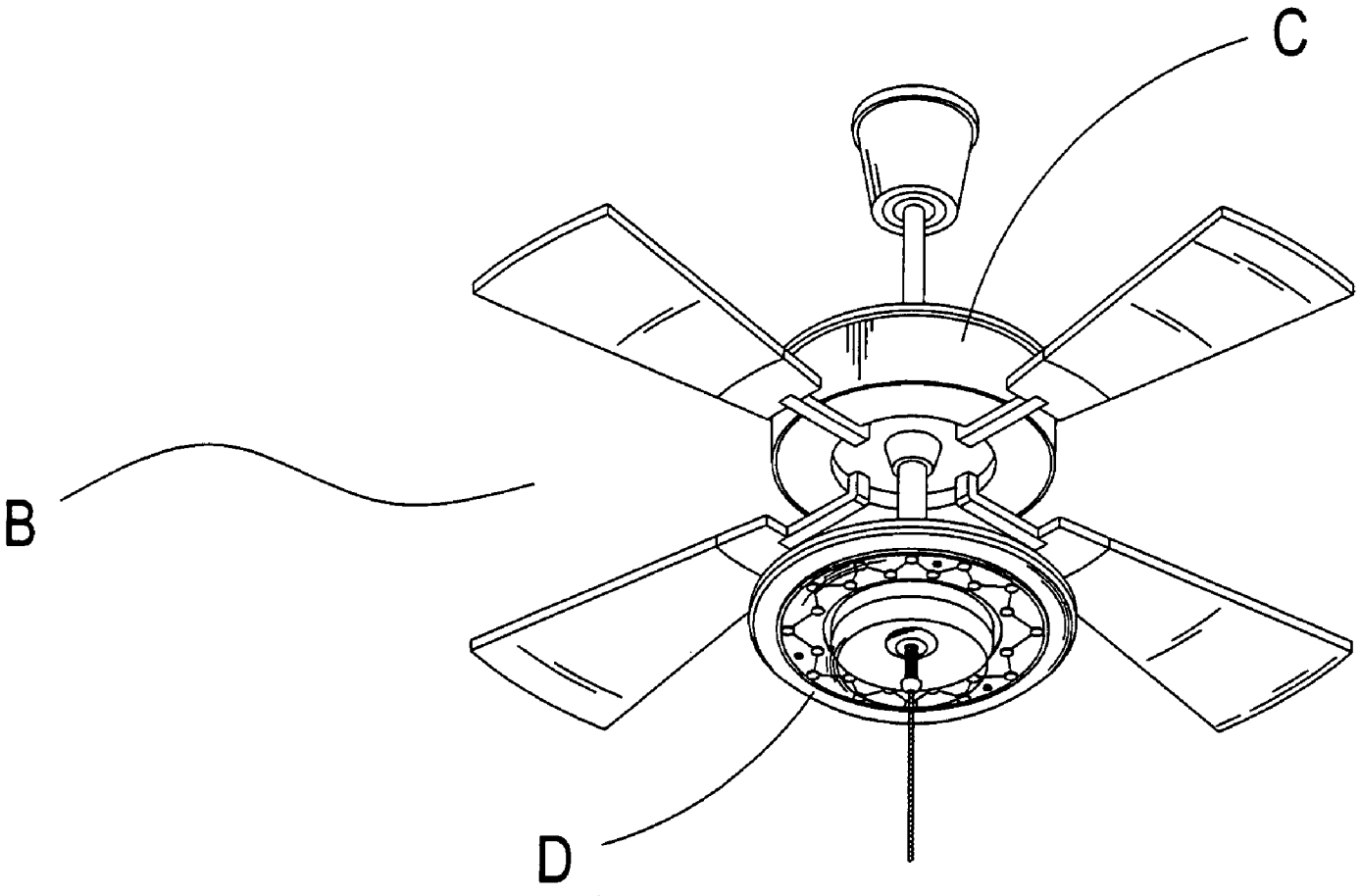
FIG. 3 shows an elevational view according to the present invention.
Figure 4:
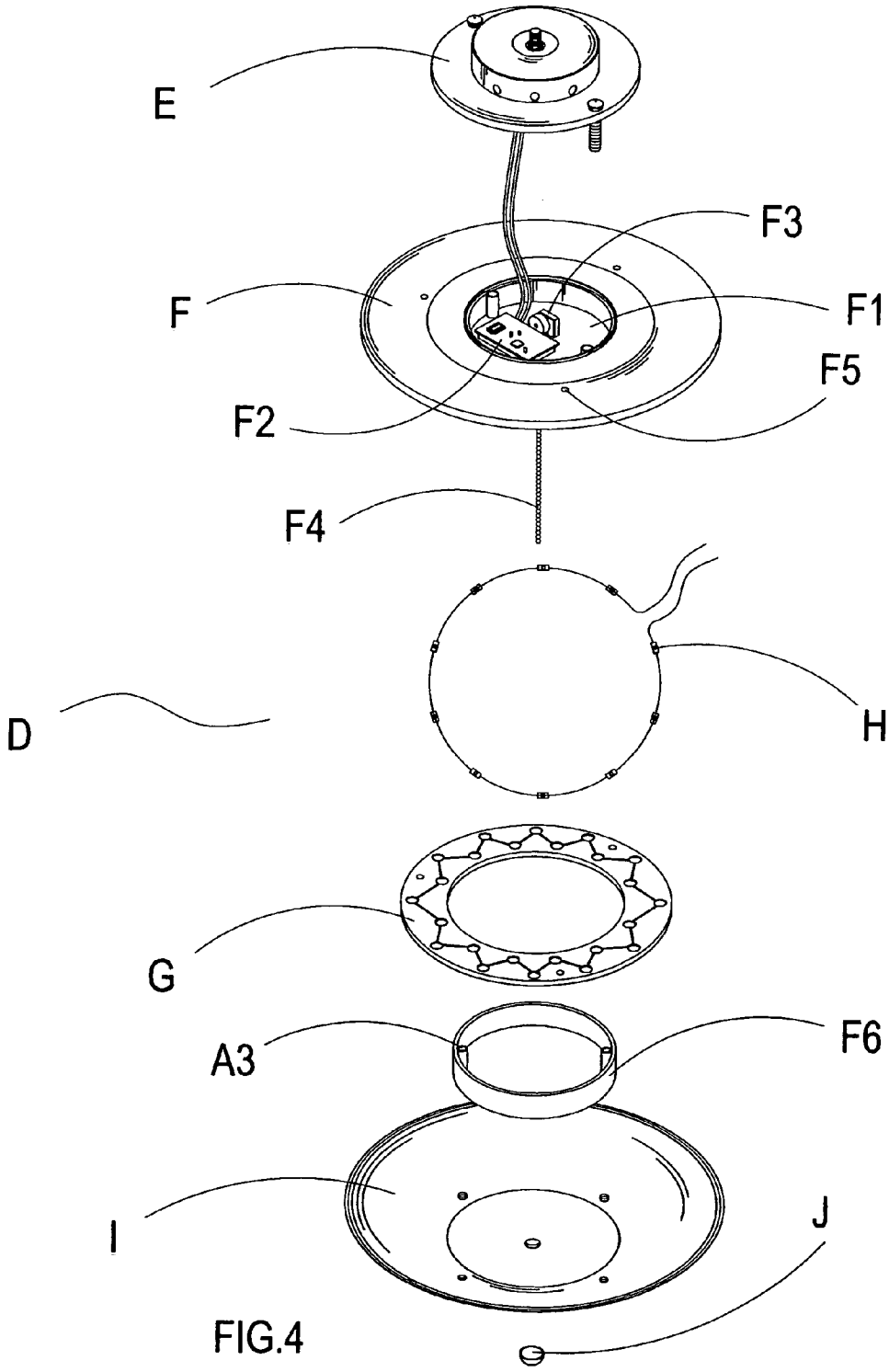
FIG. 4 shows an exploded elevational view according to the present invention.

Referring to FIG. 3, which shows a ceiling fan light LED (light emitting diode) assembly device of the present invention, wherein a ceiling fan light B is structured to comprise a suspended mount C and a light body D. Referring to FIG. 4, which shows the light body D structured to comprise a locking disc E, a mount disc F, a reflecting protective cover F6, a circular light mount G, light-emitting bodies H, a transparent shade I and a nut J.

When assembling the light body D of the suspended mount C, a drive circuit F2 and a pull chain switch F3 are disposed between the locking disc E and the mount disc F. Moreover, the circular light mount G and the light-emitting bodies H are affixed to a periphery of a holding space F1 using securing bolts F5. When assembling the locking disc E, the mount disc F, the reflecting protective cover F6, the circular light mount G and the light-emitting bodies H, screws K are used to screw down the locking disc E to the mount disc F, and a pull chain F4 of the pull chain switch F3 is passed through the reflecting protective cover F6 and the transparent shade 1, whereafter the nut J is used to securely screw together the entire assembled light body D device of the suspended mount C.

Characteristics of the present invention include the drive circuit F2 disposed within the holding space cavity F1 of the mount disc F, which actuates the light-emitting bodies H to emit illuminating light, and the pull chain switch F3 that controls rotating of a fan of the suspended mount C and a cutover switch action. Furthermore, the pull chain switch F3 also actuates the drive circuit F2 within the mount disc F, which thus enables the light-emitting bodies H to emit illumination.

Figure 5:
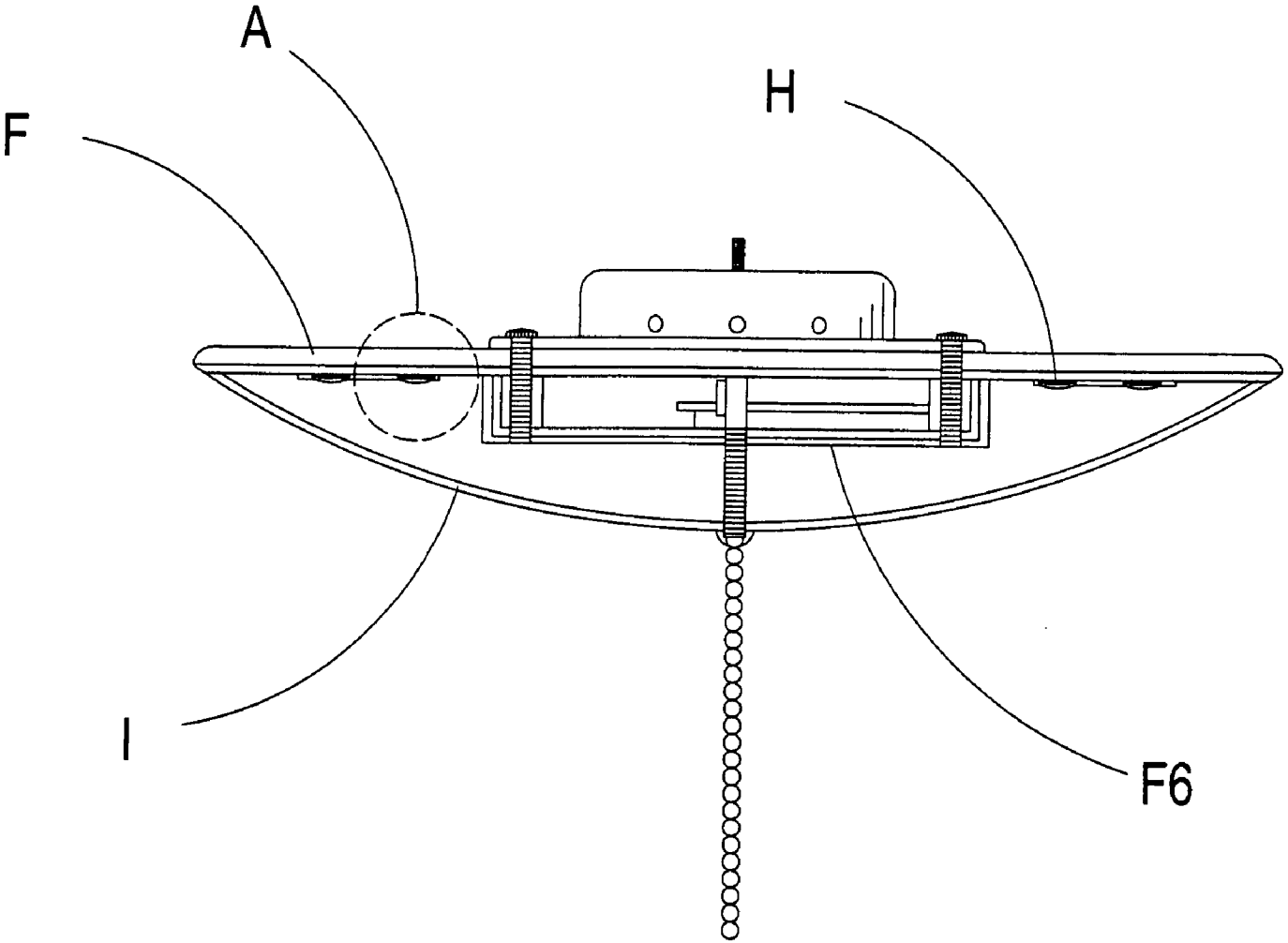
FIG. 5 shows a cross-sectional view according to the present invention.
Figure 5A:
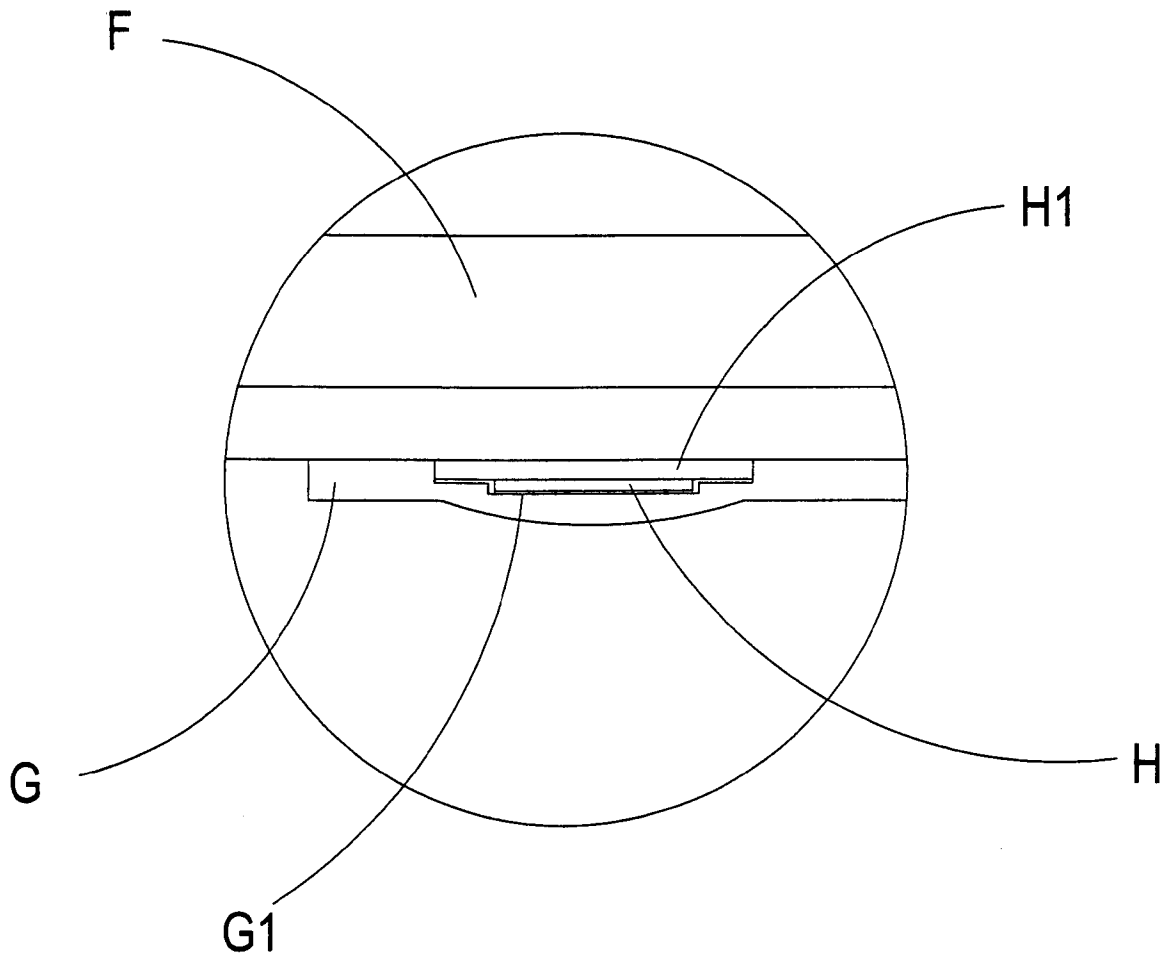
FIG. 5A shows a partial sectional-sectional view according to the present invention.

Referring to FIG. 5, which shows the reflecting protective cover F6, which produces a light focusing and refracting effect, disposed on the mount disc F. The light emitted by the light-emitting bodies H transmits not only through the reflecting protective cover F6 but also through an arched surface of the transparent shade I, thereby enhancing illumination effectiveness of the refracted light rays.

Figure 1:
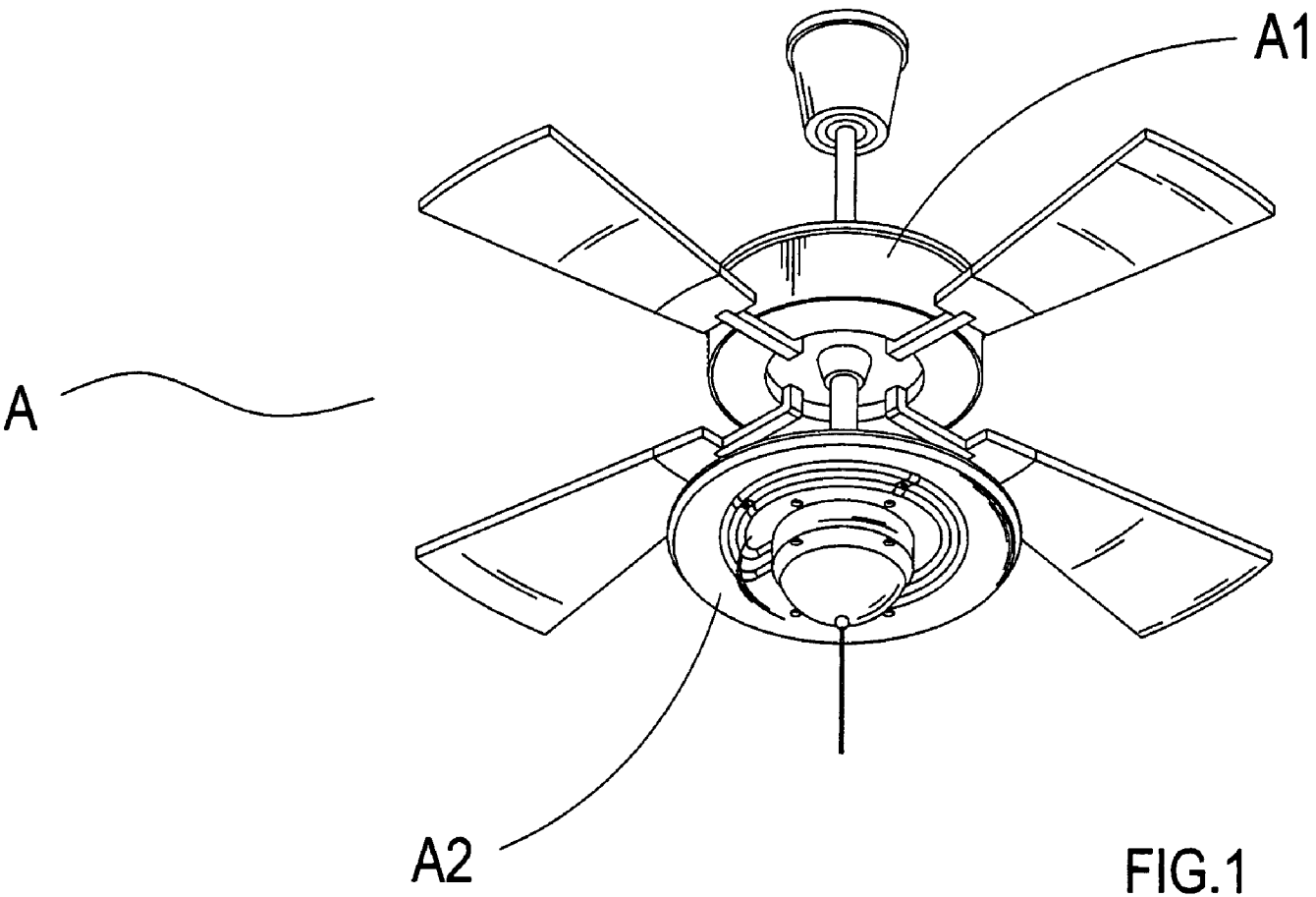
FIG.1 Prior Art
FIG. 1 shows an elevational view of a conventional ceiling fan light.
Figure 2:
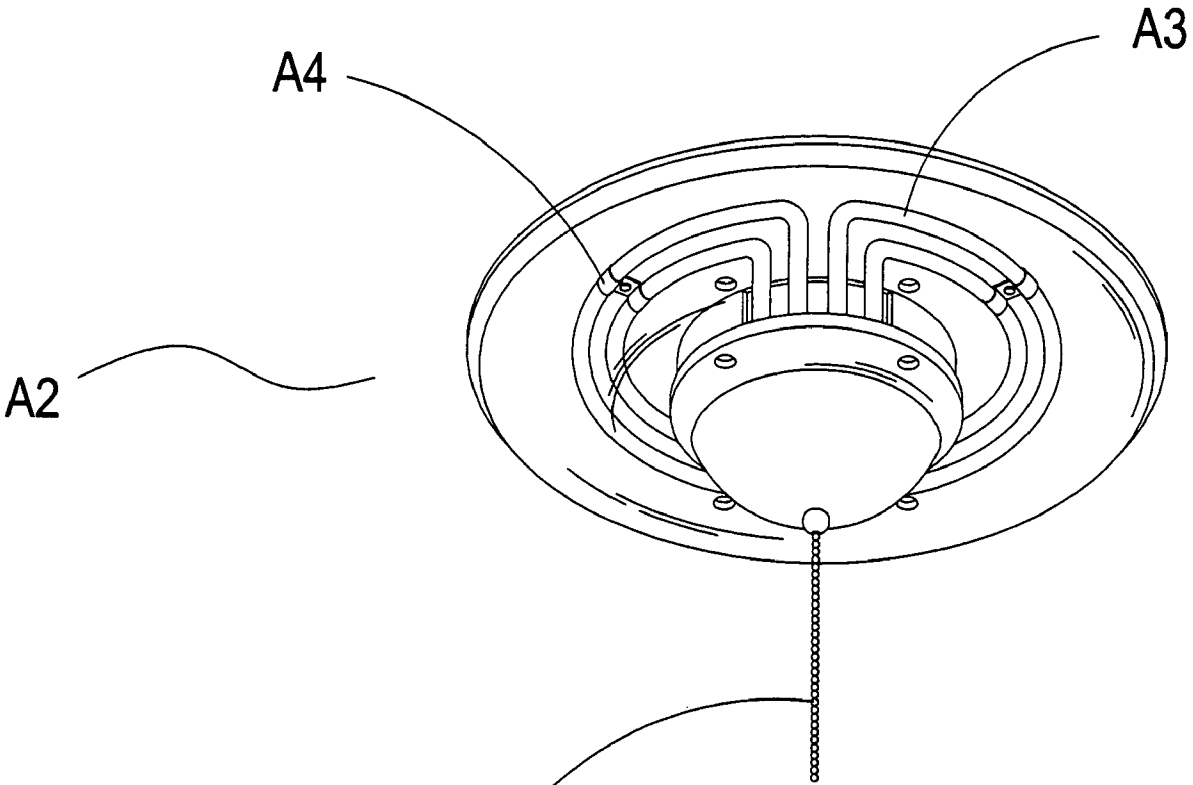
FIG.2 Prior Art
FIG. 2 shows a cutaway elevational view of a conventional ceiling fan light.

Referring to FIG. 5-1, which depicts a light circuit board H1 of light guide material disposed within the circular light mount G. The light circuit board H1 is further configured to the light-emitting bodies H that provide light illumination at a stable voltage, and the light-emitting bodies are embedded within a groove G1 of the circular light mount G.

Figure 6:
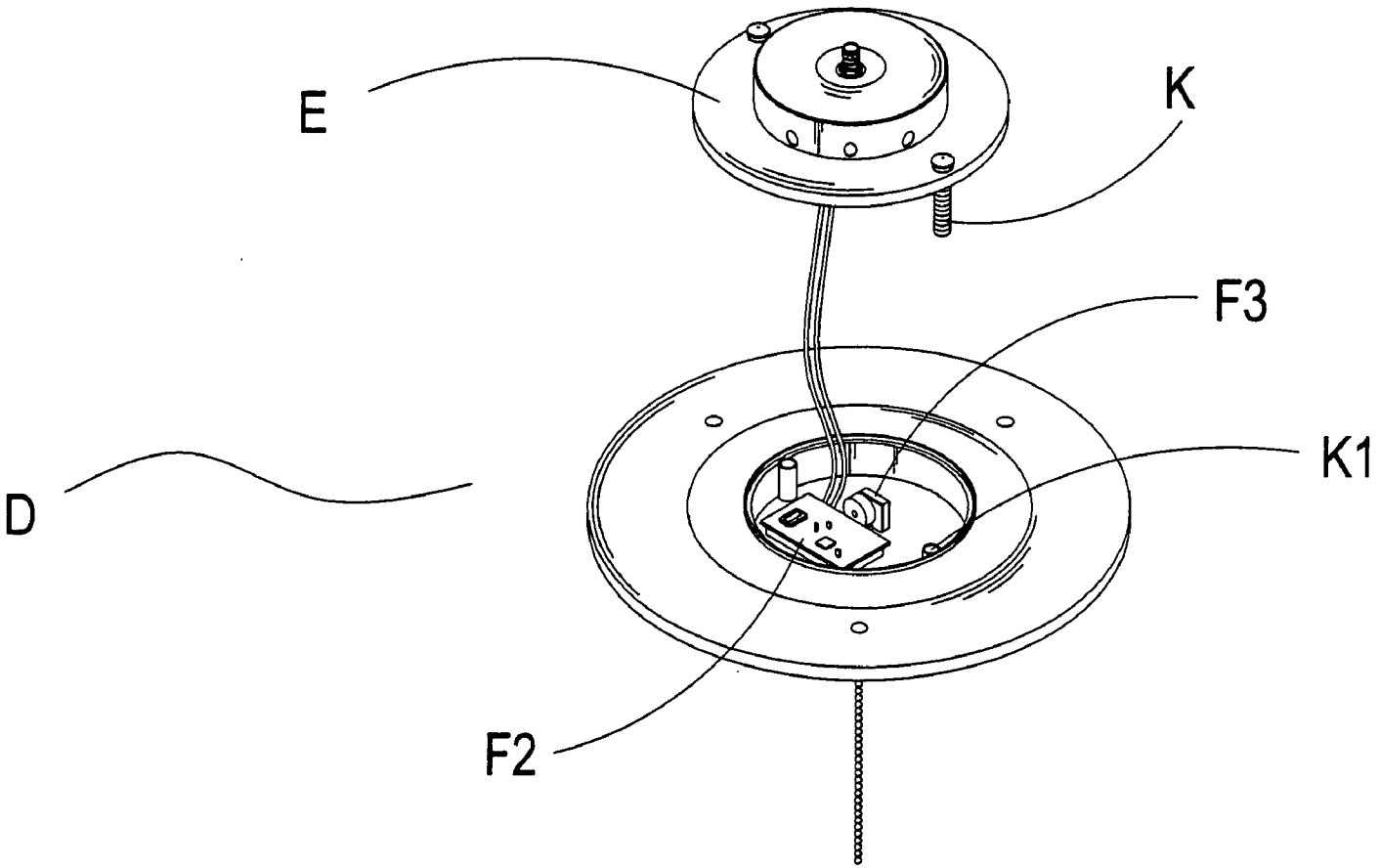
FIG. 6 shows an embodiment according to the present invention (1).

Referring to FIGS. 4 and 6, which depict embodiments of the present invention. When assembling a light body D of a suspended mount C, a locking disc E is screwed down to a mount disc F by a plurality of screws K of the locking disc E respectively screwing into a plurality of circular holes K1 of the mount disc F, and a nut J of a reflecting protective cover F6 is then used to secure the reflecting protective cover F6 to the mount disc F. Moreover, a drive circuit F2 and a pull chain switch F3 are configured within the mount disc F, wherein the drive circuit F2 controls a multi-variation of dynamic emitted light produced by light-emitting bodies H, and the pull chain switch F3 actuates a cutover switch action, thereby controlling the drive circuit F2 and the suspended mount C.

Figure 7:
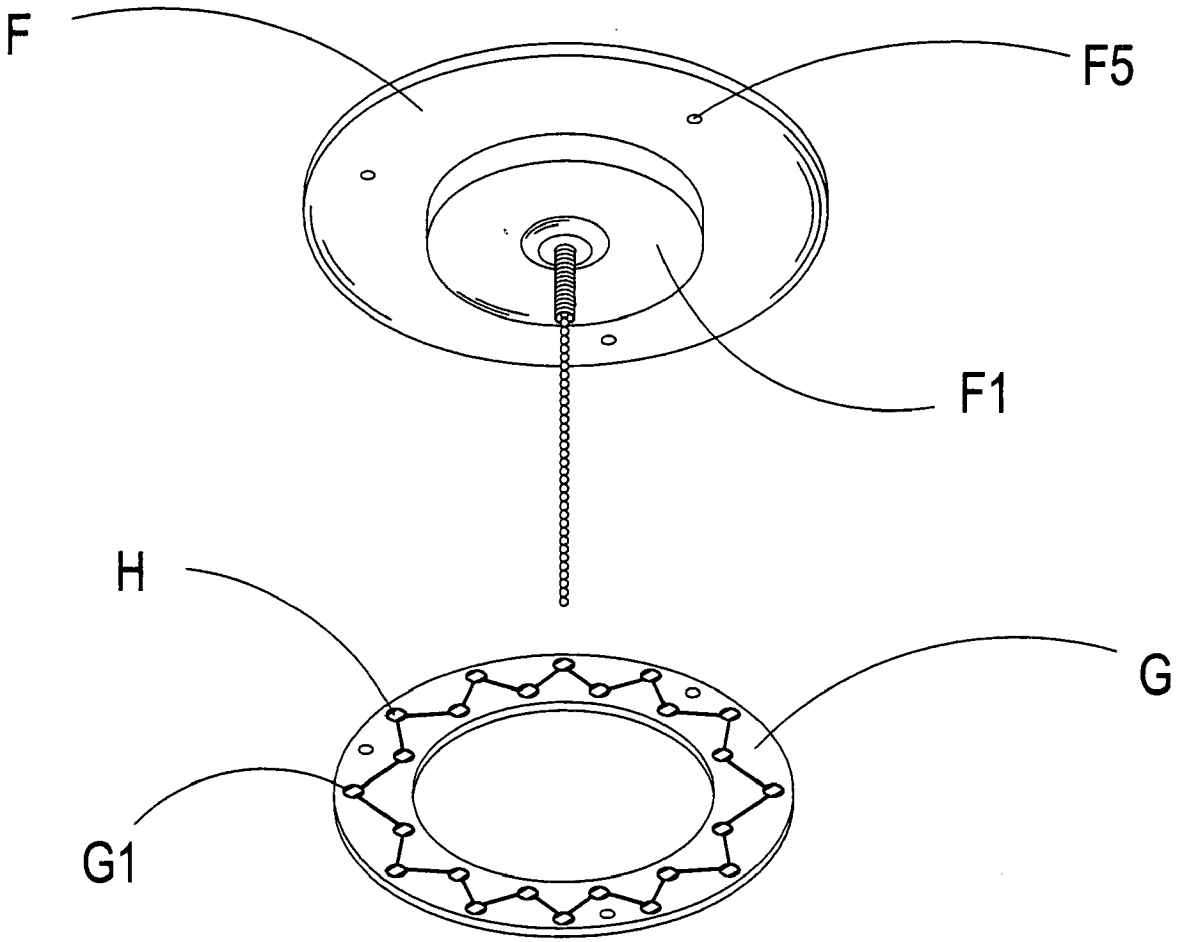
FIG. 7 shows the embodiment according to the present invention (2).

Referring to FIG. 7, which depicts disposition of the light-emitting bodies H on the circular light mount G, wherein the light-emitting bodies H are embedded within a groove G1 of the circular light mount G, and securing bolts F5 of the mount disc F are used to affix the circular light mount G and the light-emitting bodies H to a periphery of a holding space F1. Moreover, the light-emitting bodies H within the circular light mount G are connected to the drive circuit F2 and the pull chain switch F3. When the drive circuit F2 actuates a cutover switch action by means of the pull chain switch F3, the light-emitting bodies H are able to produce a multi-variation of dynamic emitted light.

Figure 8:
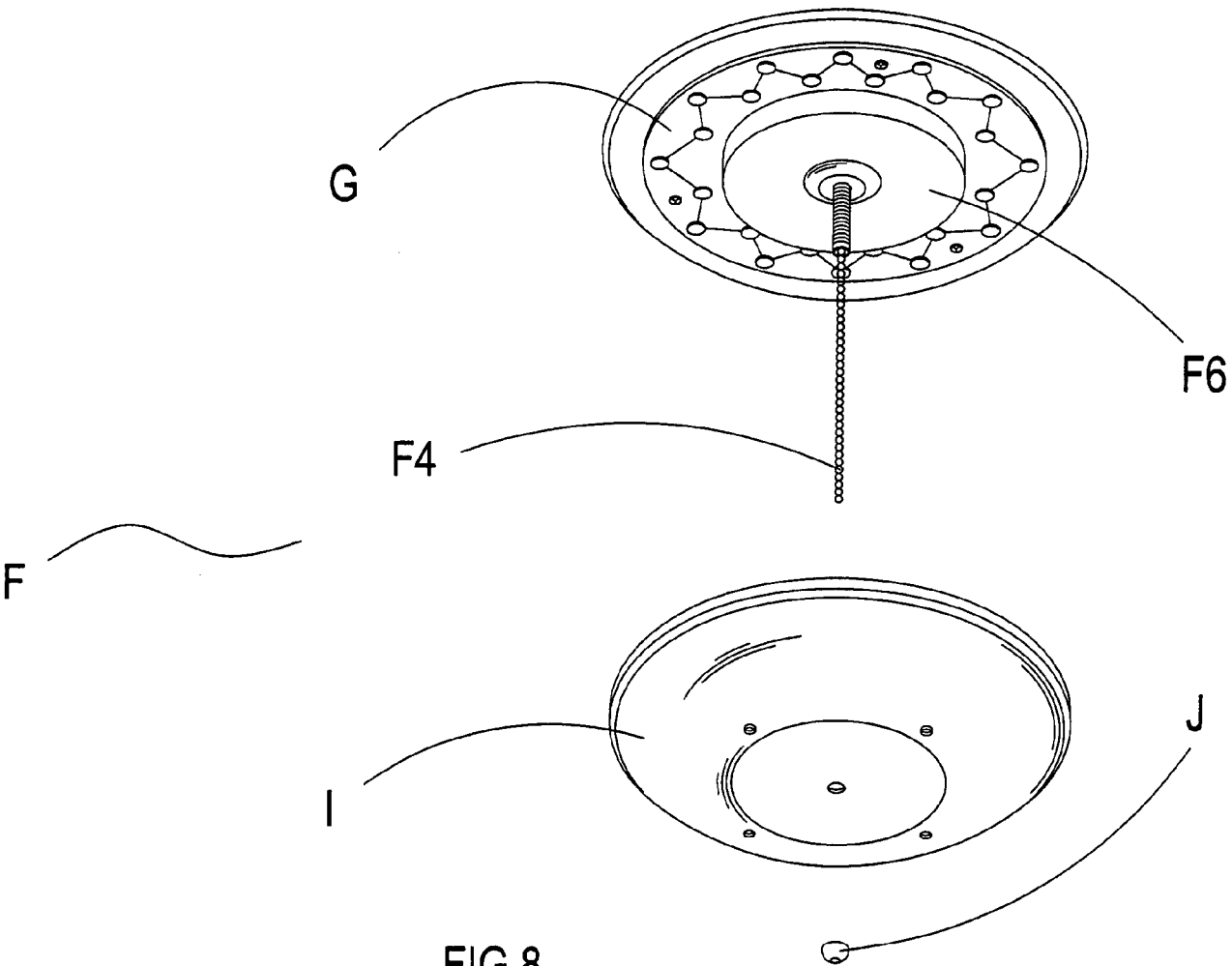
FIG. 8 shows the embodiment according to the present invention (3).

Referring to FIG. 8, after assembling the aforementioned mount disc F device and affixing it to the locking disc E by means of the screws K, the light body D of the suspended mount C is assembled by passing the pull chain F4 of the pull chain switch F3 through the reflecting protective cover F6 and the transparent shade I, and screwing down the nut J, thereby securely fixing the entire light body D assembly.

Furthermore, because the reflecting protective cover F6 on the mount disc F is provided with a light focusing and refracting effect, thus, the light emitted by the light-emitting bodies H within the circular light mount G not only transmits through the reflecting protective cover F6, but also through an arched surface of the transparent shade I, thereby enhancing illumination effectiveness of the refracted light rays.

Figure 9:
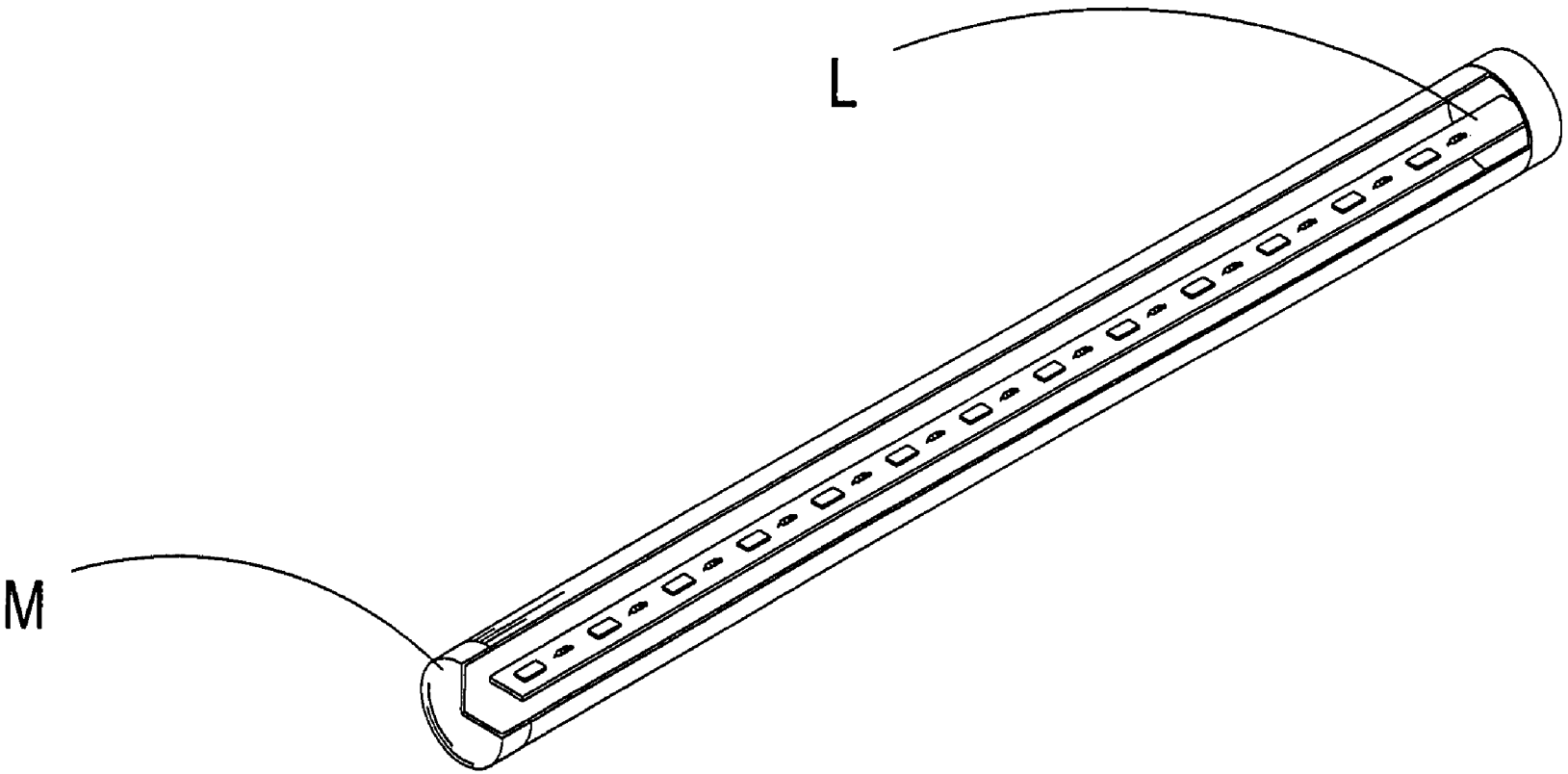
FIG. 9 shows a further embodiment according to the present invention.

Referring to FIG. 9, apart from the light-emitting bodies H within the circular light mount G providing an illumination device for the light body D of the suspended mount C, moreover, the circular light mount G and the light-emitting bodies H can be further configured as an illuminating light-emitting device L such as an emergency illumination light, a street light, a desk light, and so on. In addition, the circular light mount G can be further configured as a shaped light-emitting light tube M such as a circular light tube, a curved light tube, a cylindrical light tube, a helical light tube, a 2U/3U/4U light tube, and so on.

In order to better explicitly disclose advancement and practicability of the present invention, a comparison with conventional art is described hereinafter:

Shortcomings of Conventional Light Tubes:

1. Lack of variability in illumination light emitted.
2. Concern over environmental pollution when discarded.
3. High wastage rate.
4. A relatively high voltage is needed when illuminating.

Advantages of the Present Invention:

1. A light-emitting circuit enables the light-emitting tubes to produce a multi-variation of dynamic emitted light.
2. Operating lifespan of the light-emitting tubes is relatively long, and do not result in environment pollution when discarded.
3. Relatively low voltage is produced when the light-emitting circuit is illuminating.
4. The light-emitting circuit can be configured for different shaped light tubes.
5. Provided with practicability and advancement.
6. Enhances commercial competitiveness.

In conclusion, the present invention in overcoming structural shortcomings of prior art has assuredly achieved effectiveness of anticipated advancement, and, moreover, is easily understood by persons unfamiliar with related art. Furthermore, contents of the present invention have not been publicly disclosed prior to this application, and practicability and advancement of the present invention clearly comply with essential elements as required for a new patent application. Accordingly, a new patent application is proposed herein.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A ceiling fan light LED assembly device comprising:

a light body having:

a) a locking disc;

b) a mount disc having:

i) a holding space;

ii) a drive circuit located in the holding space; and iii) a pull chain switch located in the holding space and controlling the drive circuit;

c) a reflecting protective cover connected to a bottom of the mount disc;

d) a circular light mount connected to the bottom of the mount disc and having a groove;

e) a plurality of light emitting bodies located in the groove of the circular light mount, the plurality of light emitting bodies are electrically connected to and controlled by the drive circuit; and f) a transparent shade connected to the bottom of the mount disc.

2. The ceiling fan light LED assembly device according to claim 1, wherein the plurality of light emitting bodies transmit a light through the reflecting protective cover and the transparent shade.

3. The ceiling fan light LED assembly device according to claim 1, wherein the circular light mount and the plurality of light emitting bodies are configured as a device selected from a group consisting of an emergency illumination light, a street light, and a desk light.

4. The ceiling fan light LED assembly device according to claim 1, wherein the circular light mount is configured as a light-emitting light tube selected from a group consisting of a circular light tube, a curved light tube, a cylindrical light tube, a helical light tube, and a 2U/3U/4U light tube.

5. The ceiling fan light LED assembly device according to claim 1, wherein the plurality of light emitting bodies display dynamic light emitting states selected from a group consisting of a prolonged constant light state, a gradually dimming and brightening varied light state, and a successively flashing bright and dim light state.

* * * * *